United States Patent [19]

Berge

[11] 3,981,090

[45] Sept. 21, 1976

[54] APPARATUS FOR DISPLAYING CHANGEABLE ARRANGEMENTS OF INDICIA

[76] Inventor: Arthur Berge, Wennerbergsgatan 6, 112 58 Stockholm, Sweden

[22] Filed: May 23, 1974

[21] Appl. No.: 472,850

[52] U.S. Cl. ..... 40/64 R; 35/24 R

[51] Int. Cl.[2] ..... G09F 11/30

[58] Field of Search ..... 40/64 R, 65; 35/24 R, 35/24 A, 24 B, 76; 116/135, 133

[56] References Cited

UNITED STATES PATENTS

| | | | |
|---|---|---|---|
| 3,553,854 | 1/1971 | Biltz | 35/24 R |
| 3,680,525 | 8/1972 | Berge | 35/76 X |

*Primary Examiner*—Louis G. Mancene
*Assistant Examiner*—John H. Wolff
*Attorney, Agent, or Firm*—Young & Thompson

[57] ABSTRACT

Apparatus for displaying changeable arrangements of indicia arranged in horizontal rows and vertical columns, comprises a support for the indicia having a surface that circulates in a horizontal direction and which may be a cylindrical drum or an endless belt. The indicia are arranged on this surface in horizontal rows that may be shifted lengthwise, and for this purpose may be attached to the surface magnetically or slide thereon in horizontal grooves. The columns are marked on the circulating surface, while the rows are identified by a vertically disposed rectangular reference plate that rotates about a vertical axis for utilization of both sides thereof, the rows on the reference plate and the rows on the circulating surface being in horizontal registry with each other.

4 Claims, 8 Drawing Figures

Fig.4
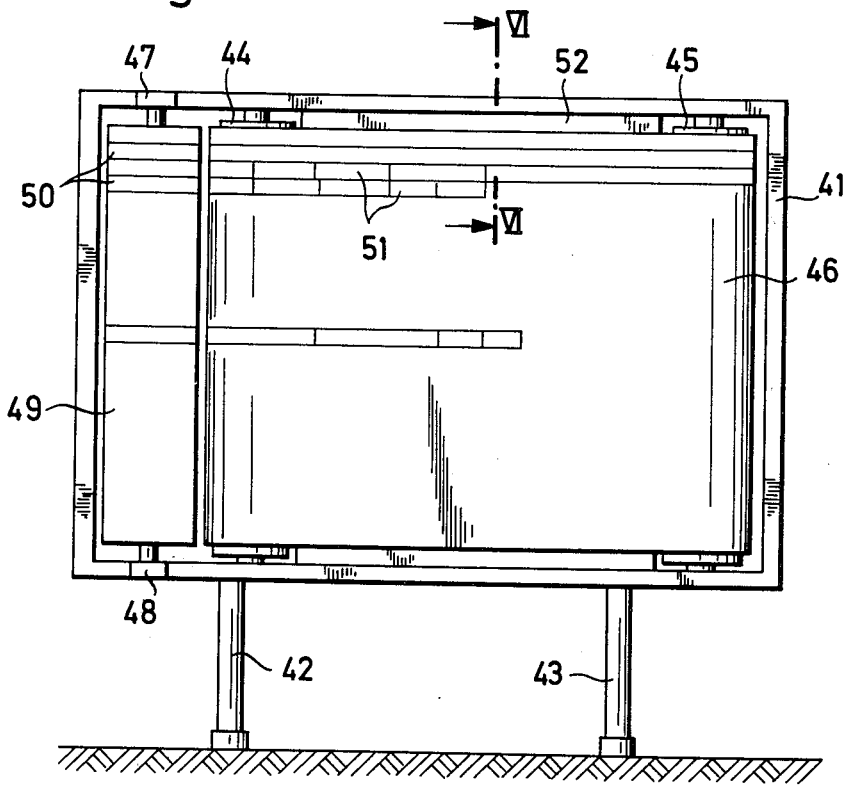
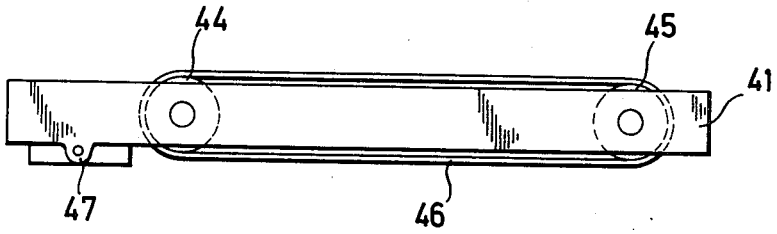
Fig.5

APPARATUS FOR DISPLAYING CHANGEABLE ARRANGEMENTS OF INDICIA

The present invention relates to apparatus for displaying changeable arrangements of indicia which are useful, among other things, for program planning, financial and budget planning, and operations research.

Devices of this type are disclosed in U.S. Pat. Nos. 3,270,707 and 3,680,525, and are broadly characterized by the provision of indicia which may be arranged as desired in vertical columns and horizontal rows for the purpose of indicating any of a number of desired types of information.

Devices of this type have been successfully used for many purposes but they have suffered from the drawback that for certain problems important in industry and transportation, the indicia being movable in a single plane, it is from time to time necessary to perform a fundamental rearrangement of the indicia; and this is quite time-consuming and bothersome.

It is accordingly an object of the present invention to provide such apparatus, in which the need for fundamental rearrangement of the indicia is at least greatly reduced.

Another object of the present invention is the provision of such a device, in which the size of the device may be reduced and/or the area available for display of the indicia may be increased.

Finally, it is an object of the present invention to provide such apparatus, which will be relatively inexpensive to manufacture, easy to assemble and adjust, and rugged and durable in use.

Broadly, the objects of the present invention are achieved by providing such apparatus, in which the surface on which the indicia are displayed and along which the indicia can move in at least one direction, is continuous and is adapted to circulate relative to a reference area by which the horizontal rows of the indicia are identified. The display surface may be a surface of a cylinder or endless belt, and the indicia may be adjustably displayed thereon by magnetic attraction or by the slidable mounting of the indicia in horizontal grooves on the display surface.

These and other objects, features and advantages of the present invention will become apparent from a consideration of the following description, taken in connection with the accompanying drawings, in which:

FIG. 4 is an elevational view of a third embodiment of apparatus according to the present invention;

FIG. 5 is a top plan view of the apparatus of FIG. 4;

Figure 1:
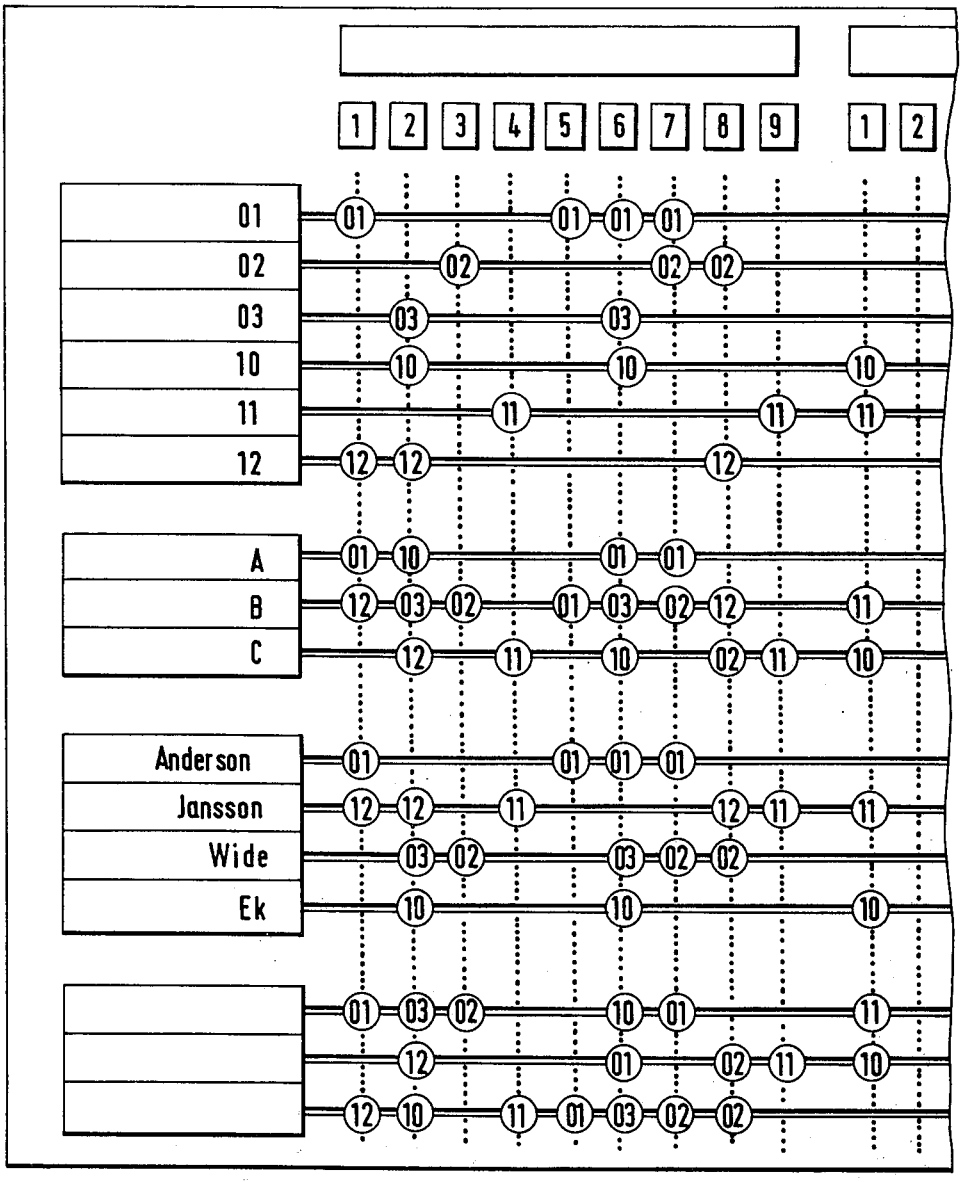
FIG. 1 is a fragmentary elevational view of a display device according to the prior art.

Referring now to the drawings in greater detail, there is shown in FIG. 1 apparatus as in the above-identified U.S. Pat. No. 3,680,525, in which the columns indicate days and hours and the rows represent activities and resources. In the illustrated embodiment of the prior art, the activities are in the nature of school subjects indicated numerically in the first six rows, while the available classrooms are designated A, B and C. The teachers, who in this case are the resources, are named in the next four rows. The indicia are comprised by circular discs bearing numerals that are slidable in horizontal slots, the position of the indicia in the slots giving the desired information. However, to start over or to repeat the display of indicia, or to render the display cyclical, it is necessary to perform a profound repositioning of these indicia in the slots, which is not convenient with a prior art device such as is shown in FIG. 1.

Figure 2:
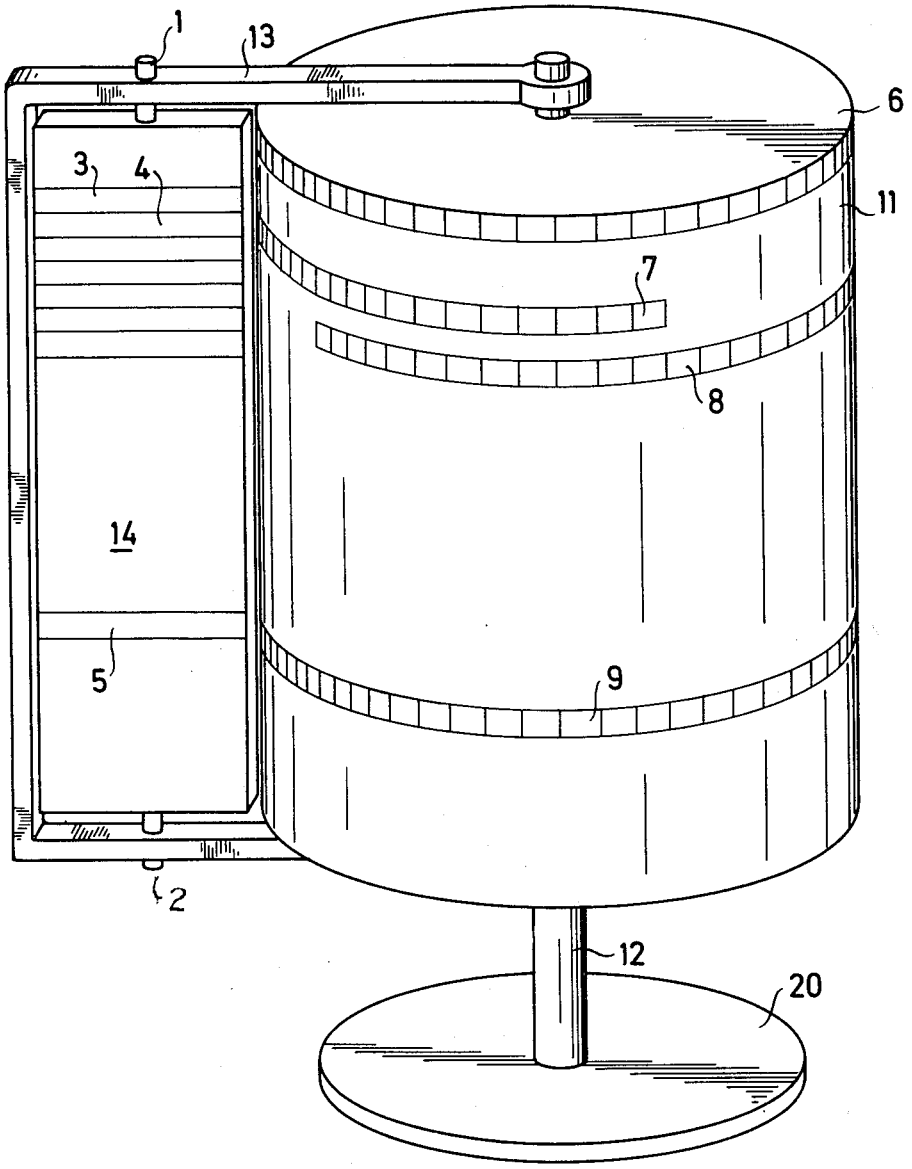
FIG. 2 is a perspective view of a first embodiment of apparatus according to the present invention.

The first embodiment of apparatus according to the present invention is shown in FIG. 2, in which a cylinder 11 is mounted for rotation about its vertical axis on a standard 12 that is supported by a base 20. Standard 12 carries a U-shaped frame 13 which rotatably receives vertical pins and 2 between which a rectangular plate 14 is mounted for rotation about the vertical axis defined by pins 1 and 2, which is the vertical midplane of plate 14. Plate 14 carries the designations 3, 4 of the horizontal rows.

On cylinder 11, the upper end 6 carries indicia indicating the nature of the columns, the movable or adjustable indicia 7, 8 and 9 being in the form of horizontal strips magnetically secured to the ferrous metal of cylinder 11.

The desired indications are thus readily given by comparison of the rows and columns adjacent and immediately to the right of plate 14 as seen in FIG. 2. The indicia can be moved peripherally about cylinder 11, while a fresh portion of cylinder 11 may in turn be moved into contiguous relation with plate 14. This can be done endlessly, as the peripheral surface of cylinder 11 is of course continuous. Therefore, there should be no occasion, during the course of a continuous program of indication, to make a fundamental rearrangement of the indicia on the peripheral surface of cylinder 11.

Figure 3:
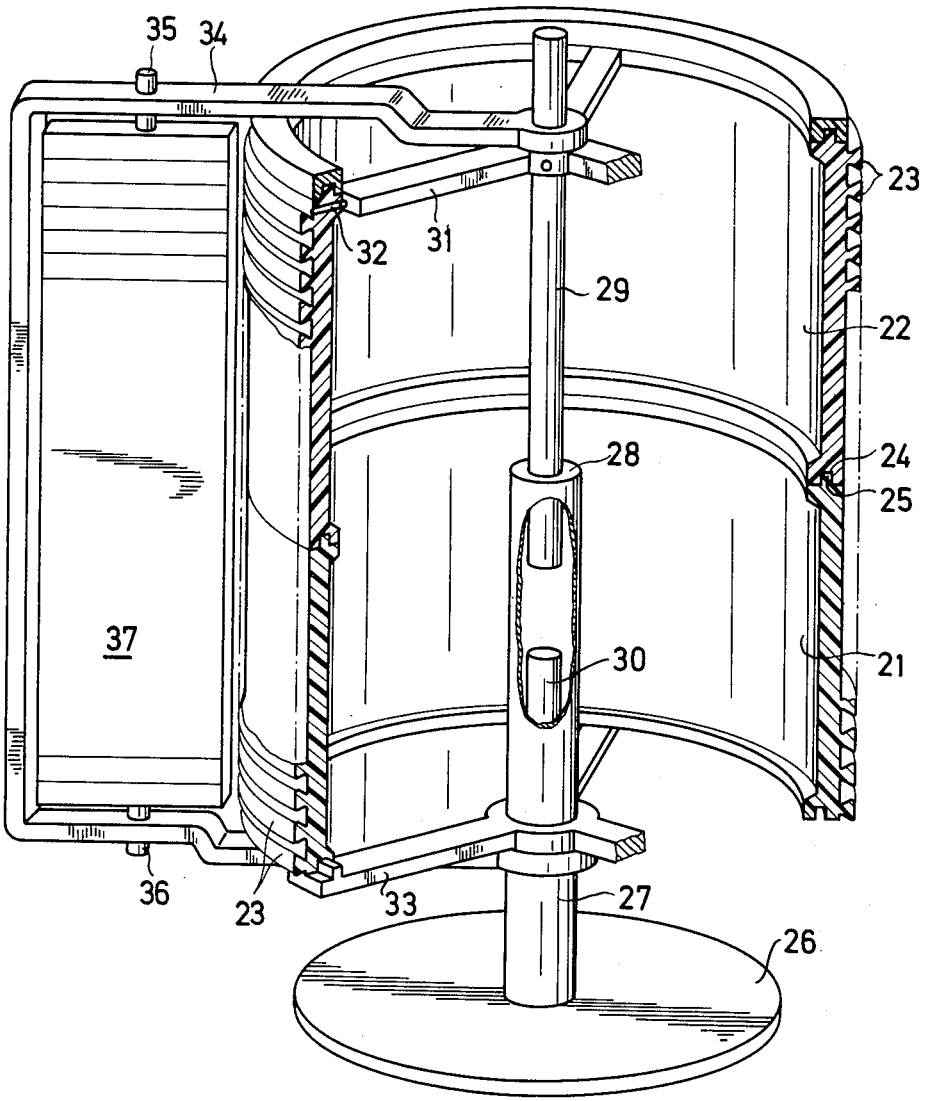
FIG. 3 is a view similar to FIG. 2, but with parts broken away, of a second embodiment of apparatus according to the present invention.

Instead of magnetic securement of the indicia on the display surface, card pockets, peg holes and pegs and various types of tracks and rails can alternatively be used. FIG. 3 shows a particularly advantageous arrangement, in which horizontal grooves are defined between horizontal ribs 23, the indicia sliding in these grooves as in FIG. 1. These grooves and ribs are continuous about the periphery of the cylinder, which is comprised of two superposed cylinder sections 21, 22 that fit together by tongue and groove connections 24, 25 and may be secured together for example by cementing or the like. The device of FIG. 3 is supported on a base 26 by a standard 27 which terminates upwardly in a rod 30 surrounded by a hollow sleeve that at its upper end 28 is traversed slidably by rod 29. It is possible to use fluid pressure (not shown) by conventional means applied to this hollow sleeve to raise or lower the cylinder.

A spider 31 secured to rod 29 is secured at 32 to the upper cylindrical section 22. A lower spider 33 is supported on standard 27, the frame 34 and spider 33 being slidable on the standard 27 to accommodate vertical movement of the cylinder.

Frame 34 has pins 35 and 36 extending therethrough to support a rectangular plate 37 that identifies the horizontal lines, as in FIG. 2, and that is rotatable about a vertical axis.

The cylinder of FIG. 3 is of course rotatable on and relative to the standard 27 and relative to the plate 37 about its own vertical axis.

Figure 6:
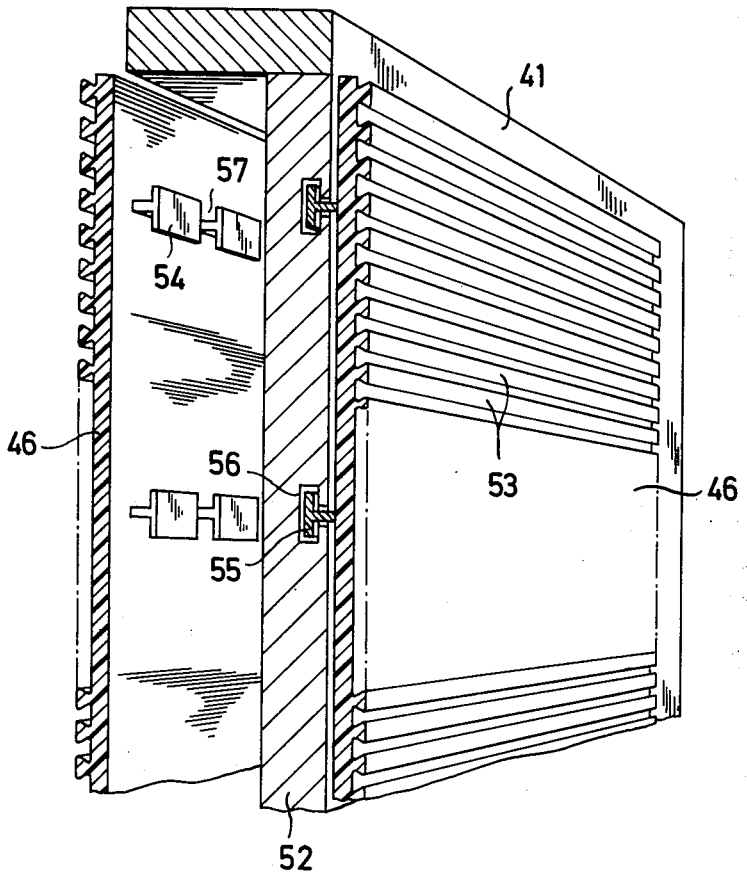
FIG. 6 is an enlarged fragmentary perspective view in cross section of a portion of FIG. 4, taken on the line VI—VI of FIG. 4.

FIGS. 4–6 show a device adapted for larger displays, in which a frame 41 supported on legs 42 and 43 has two upright rotatable rollers 44, 45 about which an endless flexible belt 46 is trained. Frame 41 also has bearings 47 and 48 for the pivotal mounting about a vertical axis of a plate 49 which carries row indicators 50 thereon that register with indicia rows 51 on belt 46.

As seen in FIG. 6, belt 46 has a plurality of horizontal spaced ribs 53 thereon that define grooves therebetween for the slidable reception of indicia (not shown). On its rear, belt 46 has spaced T-shaped lugs 54, 55 that ride in T-shaped recessed trackways 56 in the uprights 52 of frame 41 and that have gaps 57 therebetween so as to improve the flexibility of the belt about the end rollers 44 and 45. The T profiles 54 and 55 help stabilize the relatively wide belt 46 against deformation at right angles thereto in any direction.

Figure 7:
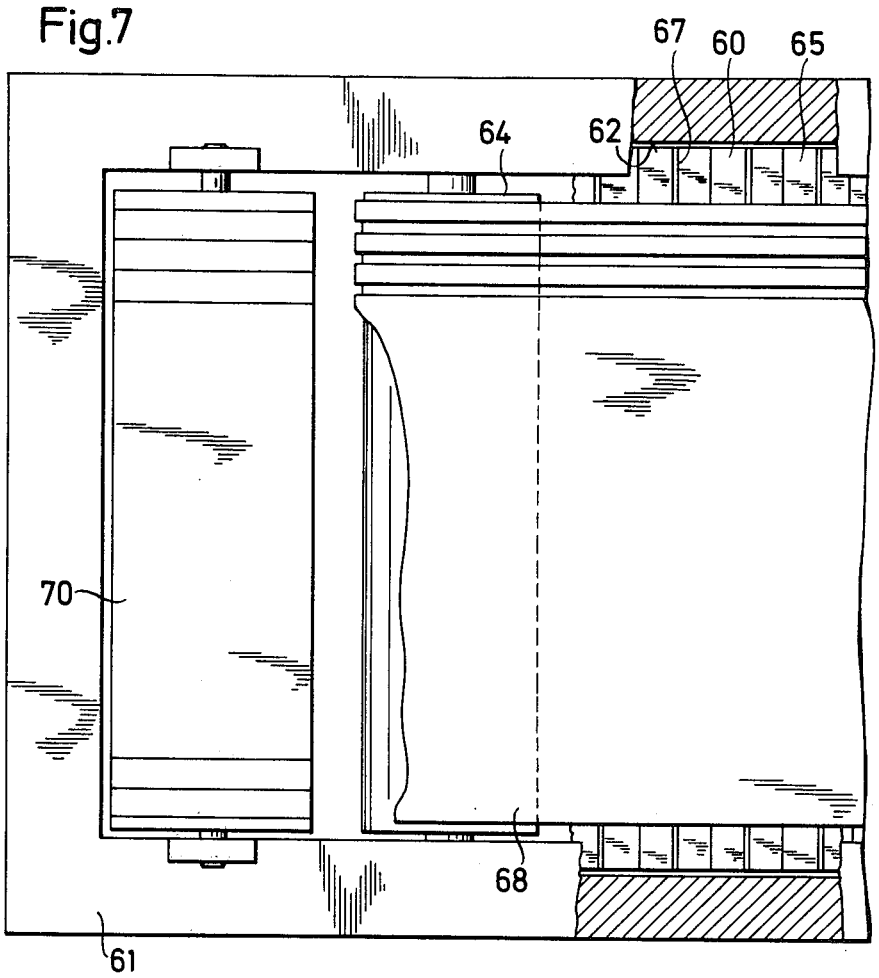
FIG. 7 is a view similar to FIG. 4, of a further embodiment of the present invention, with parts broken away for clarity.
Figure 8:
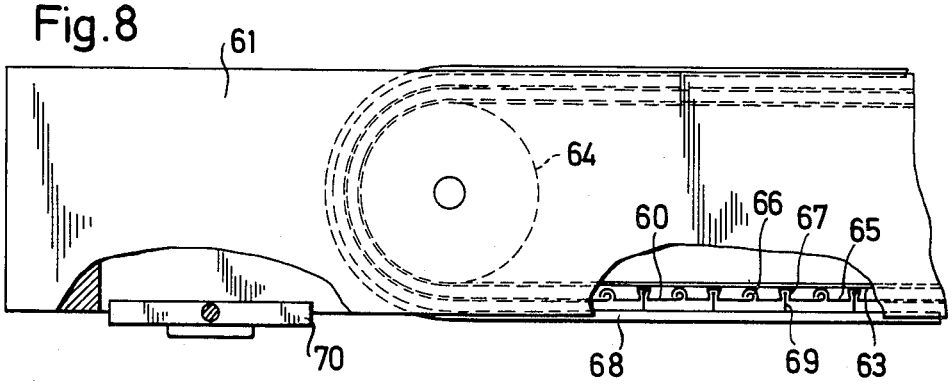
FIG. 8 is a top plan view of the structure shown in FIG. 7.

FIGS. 7 and 8 show a still further embodiment of the invention, in which a frame 61 has upper and lower tracks 62, 63, in which an articulated sheet metal belt 60 slides about two rolls, one of which is shown at 64. The links 65 of the belt 60 are articulated at 66 and are provided at 67 with longitudinally extending recesses in which are disposed are the T-shaped elements 69 of a belt 68 that is otherwise similar to belt 46. A plate 70 rotates about a vertical axis and identifies the horizontal rows in the same manner as previously described.

It will be understood that in all of the foregoing embodiments, the plate that identifies the rows is rotatable about 180° so as to make it possible to utilize both sides of the plate. For example, if the indicia on that plate are chronological, then each side of the plate might correspond to a different half of the year.

From a consideration of the foregoing disclosure, therefore, it will be evident that all of the initially recited objects of the present invention have been achieved.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

Having described my invention, I claim:

1. A device for information handling including a support element movable in an endless path and having column indicators thereon, vertically spaced horizontal grooves in the support element arranged to form rows, selectively positionable indicia in the grooves, and a rotatably mounted identifying plate juxtaposed with the support element wherein the plate has identifying rows on both sides of the plate aligned with the slots of the support element, a base on which said device is supported, a standard upstanding from said base, a vertical rod mounted for vertical sliding movement on and relative to said standard, said support element being secured to said rod, a frame in which said plate is rotatably mounted, said frame being movable vertically with said rod and being slidable vertically on said standard, whereby the program range of the information handling device can be doubled by rotating opposite sides of the plate into row registry with the support element and the weight of the plate and support element can be adjusted relative to said base.

2. A device as in claim 1 wherein the support element comprises cylinder means.

3. A device as in claim 2 wherein the cylinder means includes vertically aligned plural sections coupled together by a tongue-groove connection.

4. A device as in claim 1 wherein said identifying plate is mounted for rotation about a vertical axis lying on the vertical mid-plane of said plate.

* * * * *